US010830533B2

(12) United States Patent
Jung

(10) Patent No.: US 10,830,533 B2
(45) Date of Patent: Nov. 10, 2020

(54) VESSEL COMPRISING ENGINE

(71) Applicant: DAEWOO SHIPBUILDING & MARINE ENGINEERING CO., LTD., Seoul (KR)

(72) Inventor: Hae Won Jung, Seoul (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 96 days.

(21) Appl. No.: 16/061,246

(22) PCT Filed: Jun. 29, 2016

(86) PCT No.: PCT/KR2016/006970
§ 371 (c)(1),
(2) Date: Jun. 11, 2018

(87) PCT Pub. No.: WO2017/099317
PCT Pub. Date: Jun. 15, 2017

(65) Prior Publication Data

US 2018/0363975 A1 Dec. 20, 2018

(30) Foreign Application Priority Data

Dec. 9, 2015 (KR) ..... 10-2015-0175091

(51) Int. Cl.
*F25J 1/00* (2006.01)
*B63H 21/38* (2006.01)
(Continued)

(52) U.S. Cl.
CPC ..... *F25J 1/0025* (2013.01); *B63B 25/14* (2013.01); *B63H 21/38* (2013.01); *F17C 6/00* (2013.01);
(Continued)

(58) Field of Classification Search
CPC ..... F25J 1/0025; F25J 1/0202; F25J 1/004; F25J 1/023; F25J 1/0264; F25J 1/0045;
(Continued)

(56) References Cited

U.S. PATENT DOCUMENTS 2,959,020 A * 11/1960 Helmut ..... F25J 1/004 62/613
3,885,394 A * 5/1975 Witt ..... B63H 21/00 60/651
(Continued)

FOREIGN PATENT DOCUMENTS

EP 3309442 A1 4/2018
JP S50-22771 A 3/1975
(Continued)

OTHER PUBLICATIONS

International Search Report of PCT/KR2016/006970 which is the parent application and its English translation—6 pages, (dated Sep. 30, 2016).
(Continued)

*Primary Examiner* — Nelson J Nieves
(74) *Attorney, Agent, or Firm* — Knobbe Martens Olson & Bear LLP

(57) ABSTRACT

A vessel comprising an engine comprises: a first self-heat exchanger for heat-exchanging boil-off gas discharged from a storage tank; a multi-stage compressor for compressing, in multi-stages, the boil-off gas, which has passed through the first self-heat exchanger after being discharged from the storage tank; a second self-heat exchanger for precooling the boil-off gas compressed by the multi-stage compressor; a first decompressor for expanding a portion of a fluid which has been cooled by the second self-heat exchanger and the first self-heat exchanger; and a second decompressor for expanding the other portion of the fluid which has been
(Continued)

cooled by the second self-heat exchanger and the first self-heat exchanger.

7 Claims, 5 Drawing Sheets

(51) Int. Cl.

| | |
|---|---|
| ***F17C 6/00*** | (2006.01) |
| ***F17C 9/00*** | (2006.01) |
| ***F25J 1/02*** | (2006.01) |
| ***B63B 25/14*** | (2006.01) |
| ***F17C 9/02*** | (2006.01) |
| ***F17C 13/08*** | (2006.01) |
| ***B63B 25/16*** | (2006.01) |

(52) U.S. Cl.
CPC ..... *F17C 9/00* (2013.01); *F17C 9/02* (2013.01); *F17C 13/082* (2013.01); *F25J 1/004* (2013.01); *F25J 1/0045* (2013.01); *F25J 1/0202* (2013.01); *F25J 1/023* (2013.01); *F25J 1/0277* (2013.01); *B63B 25/16* (2013.01); *F17C 2221/033* (2013.01); *F17C 2223/0161* (2013.01); *F17C 2223/033* (2013.01); *F17C 2225/0115* (2013.01); *F17C 2225/0123* (2013.01); *F17C 2265/033* (2013.01); *F17C 2265/038* (2013.01); *F17C 2265/066* (2013.01); *F17C 2265/07* (2013.01); *F17C 2270/0105* (2013.01); *F17C 2270/0581* (2013.01)

(58) Field of Classification Search
CPC . F25J 1/0277; F25J 1/0092; B63J 2/14; F17C 6/00; F17C 2225/0161; F17C 2225/033; F17C 2227/0306; F17C 2227/0388; F17C 2227/036; F17C 2227/0339; F17C 2227/0157; F17C 2265/038; F17C 2265/034; F17C 2265/066; F17C 2265/037; F17C 2265/033; B63H 21/38
See application file for complete search history.

(56) References Cited

U.S. PATENT DOCUMENTS

| | | | | |
|---|---|---|---|---|
| 3,919,852 | A | 11/1975 | Jones | |
| 5,036,671 | A * | 8/1991 | Nelson | F25J 1/0022 62/48.2 |
| 6,742,357 | B1 * | 6/2004 | Roberts | C09K 5/042 62/612 |
| 9,528,759 | B2 * | 12/2016 | Ransbarger | F25J 1/0022 |
| 2014/0250922 | A1 * | 9/2014 | Kang | F02M 21/0215 62/50.2 |
| 2014/0290279 | A1 * | 10/2014 | Lee | B63B 25/16 62/48.2 |
| 2015/0253073 | A1 * | 9/2015 | Lee | F25J 1/0025 62/48.2 |
| 2017/0114960 | A1 * | 4/2017 | Lee | F25J 1/004 |

FOREIGN PATENT DOCUMENTS

| | | | |
|---|---|---|---|
| JP | 2015-505941 | | 2/2015 |
| KR | 10-1310025 | B1 | 9/2013 |
| KR | 10-1356003 | B1 | 2/2014 |
| KR | 10-2014-0052896 | A | 5/2014 |
| KR | 10-1441243 | B1 | 9/2014 |
| KR | 10-2015-0039427 | A | 4/2015 |
| KR | 10-2015-0089353 | A | 8/2015 |
| KR | 10-2015-0093003 | A | 8/2015 |

OTHER PUBLICATIONS

Office Action of corresponding Korean Patent Application No. 10-2015-0175091—5 pages, (dated Feb. 7, 2017).
Office Action of corresponding Korean Patent Application No. 10-2015-0175091—4 pages, (dated Jul. 26, 2017).
Notice of Allowance of corresponding Korean Patent Application No. 10-2015-0175091—5 pages, (dated Nov. 13, 2017).
Extended European Search Report of corresponding Patent Application No. 16873183.4—10 pages (dated Jul. 16, 2019).
Office Action of corresponding Japanese Patent Application No. 2018-528324—6 pages (dated Aug. 4, 2020).

* cited by examiner

[FIG. 1]
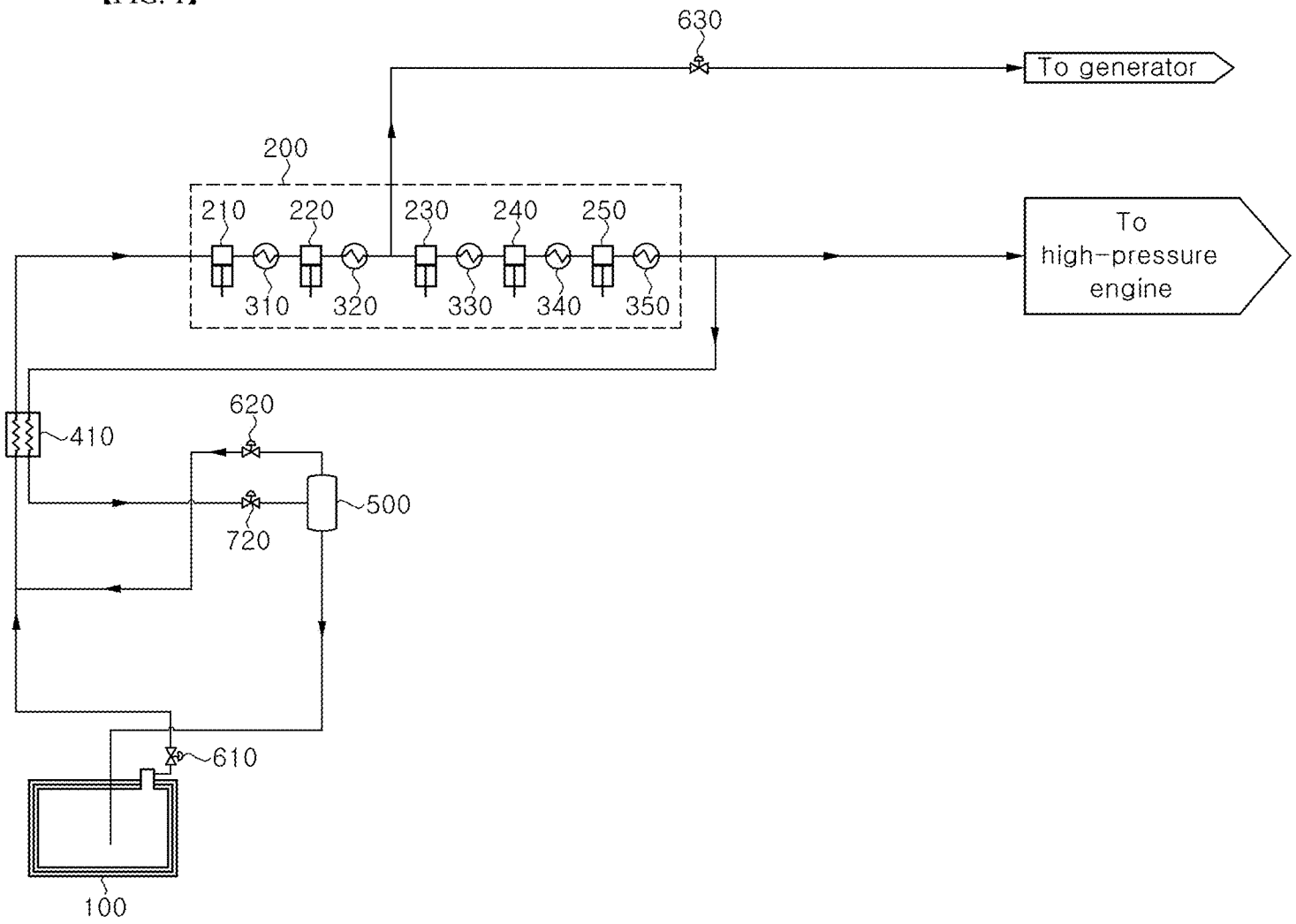

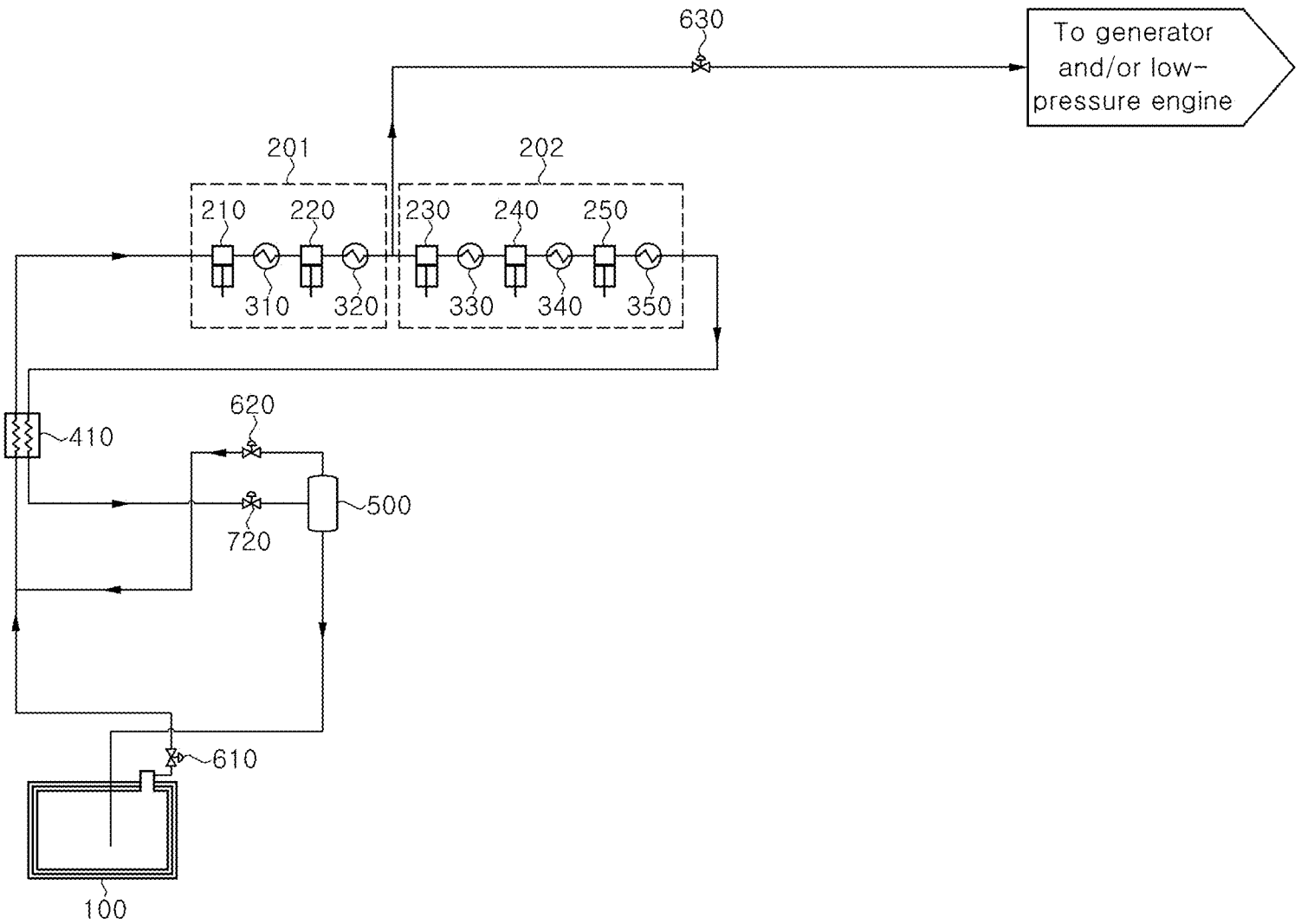
[FIG. 2]

[FIG. 3]
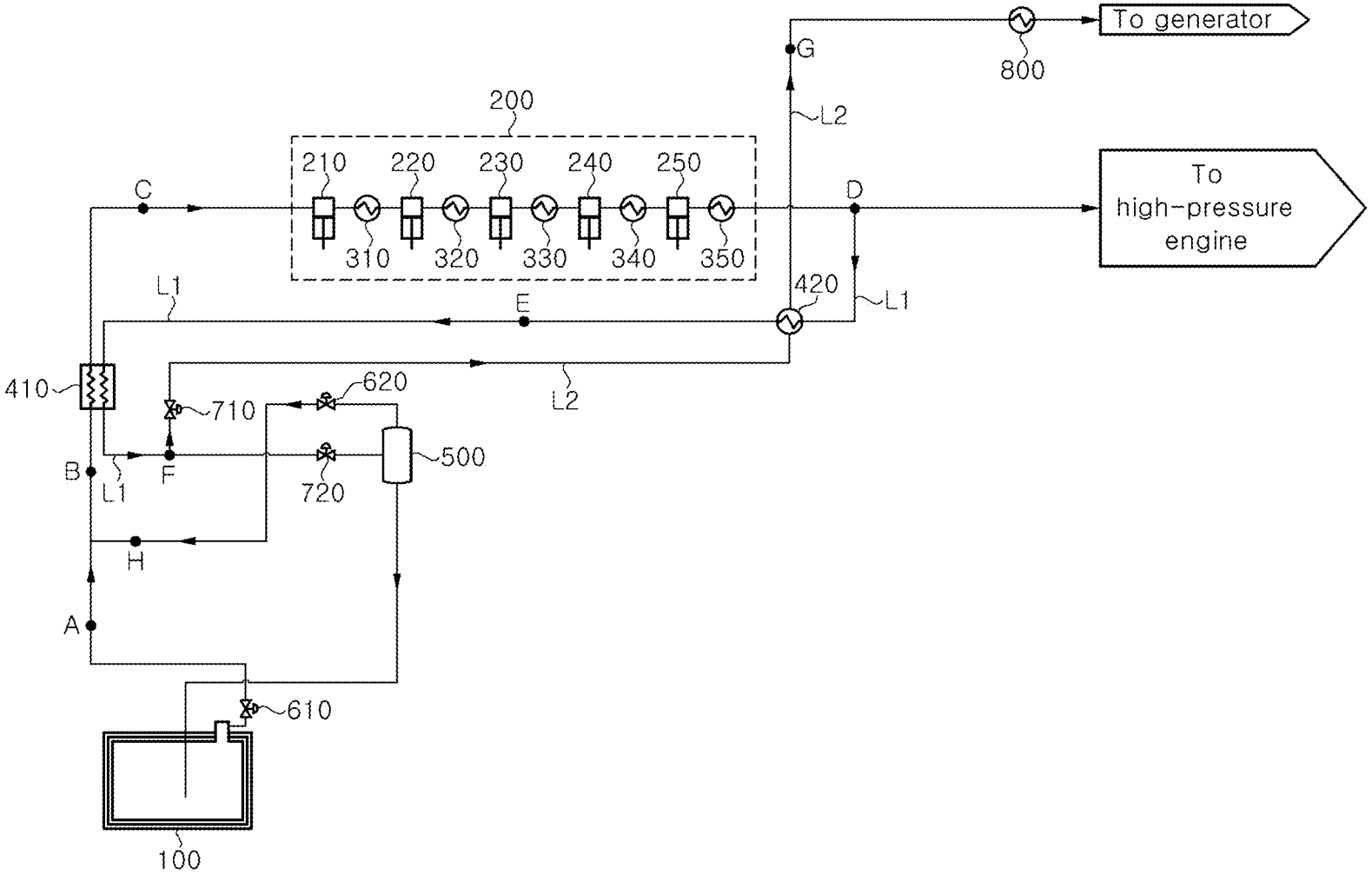

[FIG. 4]
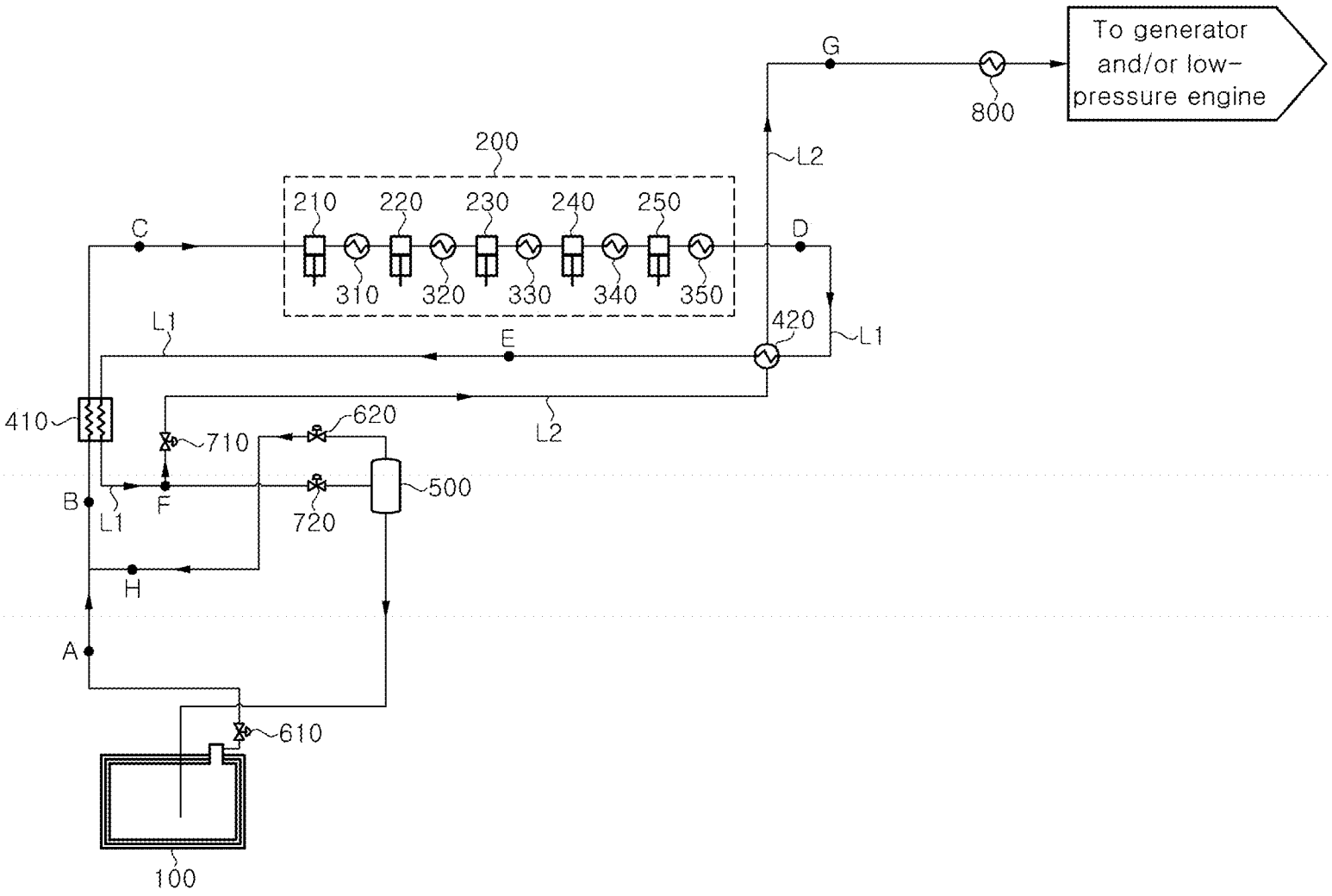

【FIG. 5】
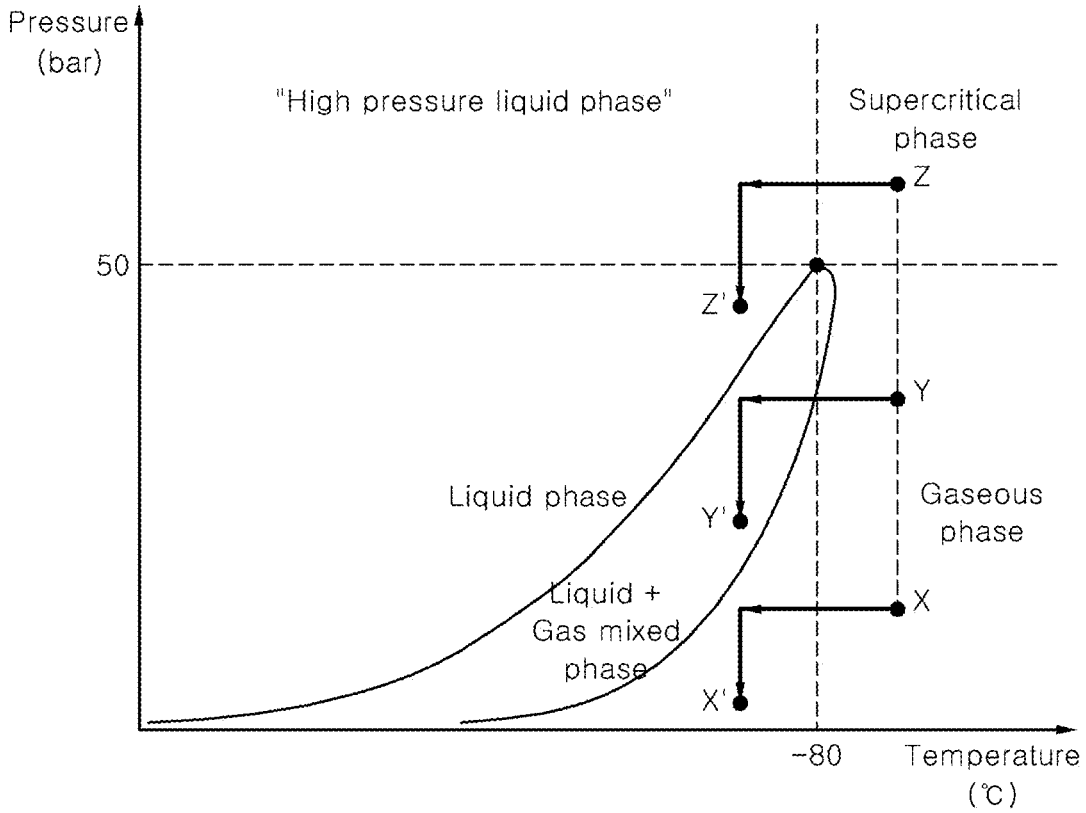

VESSEL COMPRISING ENGINE

TECHNICAL FIELD

The present invention relates to a ship including an engine and, more particularly, to a ship including an engine, in which boil-off gas (BOG) remaining after being used as fuel in the engine is reliquefied into liquefied natural gas using boil-off gas as a refrigerant and is returned to a storage tank.

BACKGROUND ART

Generally, natural gas is liquefied and transported over a long distance in the form of liquefied natural gas (LNG). Liquefied natural gas is obtained by cooling natural gas to a very low temperature of about −163° C. at atmospheric pressure and is well suited to long-distance transportation by sea, since the volume thereof is significantly reduced, as compared with natural gas in a gas phase.

Even when an LNG storage tank is insulated, there is a limit to completely block external heat. Thus, LNG is continuously vaporized in the LNG storage tank by heat transferred into the storage tank. LNG vaporized in the storage tank is referred to as boil-off gas (BOG).

If the pressure in the storage tank exceeds a predetermined safe pressure due to generation of boil-off gas, the boil-off gas is discharged from the storage tank through a safety valve. The boil-off gas discharged from the storage tank is used as fuel for a ship or is reliquefied and returned to the storage tank.

Examples of an engine capable of being fueled by natural gas include a dual fuel (DF) engine and an ME-GI engine.

The DF engine uses an Otto cycle consisting of four strokes, in which natural gas at a relatively low pressure of about 6.5 bar is injected into a combustion air inlet and then compressed by a piston moving upward.

The ME-GI engine uses a diesel cycle consisting of two strokes, in which natural gas at a high pressure of about 300 bar is injected directly into a combustion chamber near the top dead point of a piston. Recently, there is growing interest in the ME-GI engine which has better fuel efficiency and propulsion efficiency.

DISCLOSURE

Technical Problem

Typically, a boil-off gas (BOG) reliquefaction system employs a cooling cycle for reliquefaction of BOG through cooling. Cooling of BOG is performed through heat exchange with a refrigerant and a partial reliquefaction system (PRS) using BOG itself as a refrigerant is used in the art.

FIG. 1 is a schematic diagram of a partial reliquefaction system applied to a ship including a high-pressure engine in the related art.

Referring to FIG. 1, in a partial reliquefaction system applied to a ship including a high-pressure engine in the related art, BOG discharged from a storage tank 100 is sent to a self-heat exchanger 410 via a first valve 610. The BOG discharged from the storage tank 100 and subjected to heat exchange with a refrigerant in the self-heat exchanger 410 is subjected to multistage compression by a multistage compressor 200, which includes a plurality of compression cylinders 210, 220, 230, 240, 250 and a plurality of coolers 310, 320, 330, 340, 350. Then, some BOG is sent to a high-pressure engine to be used as fuel and the remaining BOG is sent to the self-heat exchanger 410 to be cooled through heat exchange with BOG discharged from the storage tank 100.

The BOG cooled by the self-heat exchanger 410 after multiple stages of compression is partially reliquefied by a decompressor 720 and is separated into liquefied natural gas generated through reliquefaction and gaseous BOG by a gas/liquid separator 500. The reliquefied natural gas separated by the gas/liquid separator 500 is sent to the storage tank 100, and the gaseous BOG separated by the gas/liquid separator 500 is joined with BOG discharged from the storage tank 100 after passing through a second valve 620 and is then sent to the self-heat exchanger 410.

On the other hand, some of the BOG discharged from the storage tank 100 and having passed through the self-heat exchanger 410 is subjected to a partial compression process among multistage compression (for example, passes through two compression cylinders 210, 220 and two coolers 310, 320 among five compression cylinders 210, 220, 230, 240, 250 and five coolers 310, 320, 330, 340, 350), divided to a third valve 630, and finally sent to a generator. Since the generator requires natural gas having a lower pressure than pressure required for the high-pressure engine, the BOG subjected to the partial compression process is supplied to the generator.

FIG. 2 is a schematic diagram of a partial reliquefaction system applied to a ship including a high-pressure engine in the related art.

Referring to FIG. 2, as in the partial reliquefaction system applied to a ship including a high-pressure engine, in a partial reliquefaction system applied to a ship including a low-pressure engine in the related art, BOG discharged from a storage tank 100 is sent to a self-heat exchanger 410 via a first valve 610. As in the partial reliquefaction system shown in FIG. 1, the BOG having been discharged from the storage tank 100 and passed through the self-heat exchanger 410 is subjected to multistage compression by multistage compressors 201, 202 and is then sent to the self-heat exchanger 410 to be cooled through heat exchange with BOG discharged from the storage tank 100.

As in the partial reliquefaction system shown in FIG. 1, the BOG cooled by the self-heat exchanger 410 after multiple stages of compression is partially reliquefied by a decompressor 720 and is separated into liquefied natural gas generated through reliquefaction and gaseous BOG by a gas/liquid separator 500. The reliquefied natural gas separated by the gas/liquid separator 500 is sent to the storage tank 100, and the gaseous BOG separated by the gas/liquid separator 500 is joined with BOG discharged from the storage tank 100 after passing through a second valve 620 and is then sent to the self-heat exchanger 410.

Here, unlike the partial reliquefaction system shown in FIG. 1, in the partial reliquefaction system applied to the ship including the low-pressure engine in the related art, the BOG subjected to the partial compression process among the multiple stages of compression is divided and sent to the generator and/or the engine and all of the BOG subjected to all of the multiple stages of compression is sent to the self-heat exchanger 410. Since the low-pressure engine requires natural gas having a similar pressure to pressure required for the generator, the BOG subjected to the partial compression process is supplied to the low-pressure engine and the generator.

In the partial reliquefaction system applied to the ship including the high-pressure engine in the related art, since some of the BOG subjected to all of the multiple stages of compression is sent to the high-pressure engine, a single multistage compressor 200 having capacity required for the high-pressure engine is installed.

However, in the partial reliquefaction system applied to the ship including the low-pressure engine in the related art, since the BOG subjected to the partial compression process among the multiple stages of compression is sent to the generator and/or the engine and the BOG subjected to all of the multiple stages of compression is not sent to the engine, none of the compression stages require a large capacity compression cylinder.

Accordingly, some of BOG compressed by a first multistage compressor 201 having a relatively large capacity is divided and sent to the generator and the engine, and the remaining BOG is additionally compressed by a second multistage compressor 201 having a relatively small capacity and sent to the self-heat exchanger 410.

In the partial reliquefaction system applied to the ship including the low-pressure engine in the related art, the capacity of the compressor is optimized depending upon the degree of compression required for the generator or the engine in order to prevent increase in manufacturing cost associated with the capacity of the compressor, and installation of two multistage compressors 201, 202 provides a drawback of troublesome maintenance and overhaul.

Embodiments of the present invention provide a ship comprising an engine, in which BOG subjected to all of the multiple stages of compression is precooled through heat exchange with BOG having low temperature and pressure prior to being sent to the self-heat exchanger 410 based on the fact that some BOG having a relatively low pressure is divided and sent to the generator (to the generator and/or the engine in the case of a low-pressure engine).

Technical Solution

In accordance with one aspect of the present invention, a ship including an engine comprises: a first self-heat exchanger performing heat exchange with respect to boil-off gas (BOG) discharged from a storage tank; a multistage compressor compressing the BOG discharged from the storage tank and having passed through the first self-heat exchanger in multiple stages; a second self-heat exchanger precooling the BOG compressed by the multistage compressor; a first decompressor expanding some of a fluid cooled by the second self-heat exchanger and the first self-heat exchanger; and a second decompressor expanding the other fluid cooled by the second self-heat exchanger and the first self-heat exchanger, wherein the first self-heat exchanger cools the BOG compressed by the multistage compressor and having passed through the second self-heat exchanger using the BOG discharged from the storage tank as a refrigerant, and the second self-heat exchanger cools the BOG compressed by the multistage compressor using the fluid expanded by the first decompressor as a refrigerant.

The fluid having passed through the second decompressor may be sent to the storage tank.

The ship may further include: a gas/liquid separator disposed downstream of the second decompressor and separating liquefied natural gas generated through reliquefaction of the BOG and gaseous BOG from each other, wherein the liquefied natural gas separated by the second gas/liquid separator is sent to the storage tank and the gaseous BOG separated by the second gas/liquid separator is sent to the first self-heat exchanger.

Some of the BOG having passed through the multistage compressor may be sent to a high-pressure engine.

The BOG having passed through the first decompressor and the second self-heat exchanger may be sent to at least one of a generator and a low-pressure engine.

The ship may further include: a heater disposed on a line along which the BOG having passed through the first decompressor and the second self-heat exchanger is sent to the generator, when the BOG having passed through the first decompressor and the second self-heat exchanger is sent to the generator.

In accordance with another aspect of the present invention, there is provided a method comprising: 1) performing multistage compression with respect to boil-off gas (BOG) discharged from a storage tank; 2) precooling the BOG subjected to multistage compression through heat exchange; 3) cooling the fluid precooled in step 2) through heat exchange with the BOG discharged from the storage tank as a refrigerant; 4) expanding, by a first decompressor, some of the fluid cooled in step 3); 5) using the fluid expanded in step 4) as a refrigerant for heat exchange in step 2); and 6) expanding and reliquefying, by a second decompressor, the other fluid cooled in step 3).

The method may further include: 7) separating gaseous BOG and liquefied natural gas generated through partial reliquefaction of the BOG expanded in step 6) from each other; and 8) sending the liquefied natural gas separated in step 7) to the storage tank and joining the gaseous BOG gas separated in step 7) with the BOG discharged from the storage tank to be used as a refrigerant for heat exchange in step 2).

Some of the BOG subjected to multistage compression in step 1) may be sent to a high-pressure engine.

The fluid expanded by the first decompressor and having been used as a refrigerant for heat exchange in step 2) may be sent to at least one of a generator and a low-pressure engine.

Advantageous Effects

According to embodiments of the invention, the ship including an engine allows BOG to be subjected to heat exchange in a self-heat exchanger after being reduced in temperature through a precooling process, thereby improving reliquefaction efficiency, and allows easy maintenance and overhaul by providing one multistage compressor even in a structure wherein the ship includes a low-pressure engine.

DESCRIPTION OF DRAWINGS

FIG. 1 is a schematic diagram of a partial reliquefaction system applied to a ship including a high-pressure engine in the related art.

FIG. 2 is a schematic diagram of a partial reliquefaction system applied to a ship including a low-pressure engine in the related art.

FIG. 3 is a schematic diagram of a partial reliquefaction system applied to a ship including a high-pressure engine according to an exemplary embodiment of the present invention.

FIG. 4 is a schematic diagram of the partial reliquefaction system applied to a ship including a low-pressure engine according to an exemplary embodiment of the present invention.

FIG. 5 is a graph depicting a phase transformation curve of methane depending upon temperature and pressure.

BEST MODE

Hereinafter, embodiments of the present invention will be described in detail with reference to the accompanying drawings. A ship including an engine according to the present invention may be applied to various marine and overland systems. Although liquefied natural gas is used by way of example in the following embodiments, it should be understood that the present invention is not limited thereto and may be applied to various liquefied gases. It should be understood that the following embodiments can be modified in various ways and do not limit the scope of the present invention.

In the following embodiments, a fluid flowing through each flow path may be in a gaseous state, a gas-liquid mixed state, a liquid state, or a supercritical fluid state depending on system operating conditions.

FIG. 3 is a schematic diagram of a partial reliquefaction system applied to a ship including a high-pressure engine according to an exemplary embodiment of the present invention.

Referring to FIG. 3, the ship according to this embodiment includes a first self-heat exchanger 410, a multistage compressor 200, a second self-heat exchanger 420, a first decompressor 710, and a second decompressor 720.

The first self-heat exchanger 410 performs heat exchange between a fluid L1 compressed by the multistage compressor 200 and having been precooled by the second self-heat exchanger 420 and BOG discharged from a storage tank 100, as a refrigerant, so as to cool the fluid L1. In the term "self-heat exchanger", "self-" means that cold BOG is used as a refrigerant for heat exchange with hot BOG.

The multistage compressor 200 performs multistage compression with respect to the BOG discharged from the storage tank 100 and having passed through the first self-heat exchanger 410. The multistage compressor 200 includes a plurality of compression cylinders 210, 220, 230, 240, 250 configured to compress BOG, and a plurality of coolers 310, 320, 330, 340, 350 disposed downstream of the plurality of compression cylinders 210, 220, 230, 240, 250, respectively, and configured to cool the BOG compressed by the compression cylinders 210, 220, 230, 240, 250 and having increased pressure and temperature. In this embodiment, the multistage compressor 200 includes five compression cylinders 210, 220, 230, 240, 250 and five coolers 310, 320, 330, 340, 350, and the BOG is subjected to five stages of compression while passing through the multistage compressor 200. However, it should be understood that this embodiment is provided for illustration only and the present invention is not limited thereto.

The second self-heat exchanger 420 cools some BOG L1 having been compressed by the multistage compressor 200 through heat exchange with a fluid L2 having been expanded by the first decompressor 710 as a refrigerant.

Boil-off gas having been compressed by the multistage compressor 200 to a pressure higher than or equal to a pressure required by the high-pressure engine is decompressed by the first decompressor 710 to be sent to a generator, and the fluid L2 reduced in both pressure and temperature by being decompressed by the first decompressor 710 is utilized in the second self-heat exchanger 420.

Since boil-off gas having been compressed by the multistage compressor 200 is precooled in the second self-heat exchanger 420 before being cooled in the first self-heat exchanger 410, the ship according to this embodiment can exhibit improved properties in terms of overall reliquefaction efficiency and reliquefaction amount.

In order to increase heat-exchange efficiency of the first self-heat exchanger 410 and the second self-heat exchanger 420, BOG is preferably compressed by the multistage compressor 200 to a pressure higher than a pressure required by the high-pressure engine. In this case, the ship further includes a decompressor (not shown) upstream of the high-pressure engine to decompress the BOG to a pressure required by the high-pressure engine before the BOG is supplied to the high-pressure engine.

The first decompressor 710 expands a fluid (L2) branched off of a fluid (L1) compressed by the multistage compressor 200 and having passed through the second self-heat exchanger 420 and the first self-heat exchanger 410 to a pressure required by the generator.

The second decompressor 720 expands and reliquefies the rest of compressed by the multistage compressor 200 and having passed through the second self-heat exchanger 420 and the first self-heat exchanger 410.

Each of the first decompressor 710 and the second decompressor 720 may be an expansion device or an expansion valve.

The ship according to this embodiment may further include a gas/liquid separator 500 that separates gaseous BOG and liquefied natural gas generated by partial reliquefaction of the BOG through compression by the multistage compressor 200, cooling by the second self-heat exchanger 420 and the first self-heat exchanger 410, and expansion by the second decompressor 720. The liquefied natural gas separated by the gas/liquid separator 500 may be sent to the storage tank 100 and the gaseous BOG separated by the gas/liquid separator 500 may be sent to the line along which the BOG is sent from the storage tank 100 to the first self-heat exchanger 410.

The ship according to this embodiment may further include at least one of a first valve 610 blocking the BOG discharged from the storage tank 100 as needed and a heater 800 heating the BOG sent to the generator through the first decompressor 710 and the second self-heat exchanger 420. The first valve 610 may be usually maintained in an open state and may be closed upon maintenance or overhaul of the storage tank 100.

In the structure wherein the ship includes the gas/liquid separator 500, the ship may further include a second valve 620 that controls the flow amount of the gaseous BOG separated by the gas/liquid separator 500 and sent to the first self-heat exchanger 410.

The flow of fluid according to this embodiment will be described hereinafter. It should be noted that temperature and pressure of BOG described hereinafter are approximately theoretical values and can be changed depending upon the temperature of the BOG, the pressure required for the engine, design of the multistage compressor, the speed of the ship, and the like.

FIG. 4 is a schematic diagram of the partial reliquefaction system applied to a ship including a low-pressure engine according to an exemplary embodiment of the present invention.

The partial reliquefaction system applied to the ship including a low-pressure engine shown in FIG. 4 is different from the partial reliquefaction system applied to the ship including a high-pressure engine shown in FIG. 3 in that some BOG subjected to multistage compression by the multistage compressor 200 is sent to the generator and/or the engine after having passed through the first decompressor 710 and the first self-heat exchanger 420, and the following description will focus on different configuration of the partial reliquefaction system. Descriptions of details of the same components as those of the ship including the high-pressure engine described above will be omitted.

Differentiation between the high-pressure engine included in the ship to which the partial reliquefaction system shown in FIG. 3 is applied and the low-pressure engine included in the ship to which the partial reliquefaction system shown in FIG. 4 is applied is based on use of natural gas having a critical pressure or more as fuel by the engine. That is, an engine using natural gas having a critical pressure or more as fuel is referred to as the high-pressure engine, and an engine using natural gas having a pressure of less than the critical pressure as fuel is referred to as the low-pressure engine.

In the present invention, the high-pressure engine may be an ME-GI engine fueled by BOG at a pressure of about 150 bar to 400 bar and the low-pressure engine may be an X-DF engine fueled by BOG at a pressure of about 16 bar or a DF engine fueled by BOG at a pressure of about 6 bar to 10 bar. Alternatively, the low-pressure engine may be a gas turbine.

Referring to FIG. 4, as in the ship including the high-pressure engine shown in FIG. 3, the ship according to this embodiment includes a first self-heat exchanger 410, a multistage compressor 200, a second self-heat exchanger 420, a first decompressor 710, and a second decompressor 720.

As in the ship including the high-pressure engine shown in FIG. 3, the first self-heat exchanger 410 according to this embodiment performs heat exchange between a fluid L1 compressed by the multistage compressor 200 and having been precooled by the second self-heat exchanger 420 and BOG discharged from a storage tank 100, as a refrigerant, so as to cool the fluid L1.

As in the ship including the high-pressure engine shown in FIG. 3, the multistage compressor 200 according to this embodiment performs multistage compression with respect to the BOG discharged from the storage tank 100 and having passed through the first self-heat exchanger 410 and may include a plurality of compression cylinders 210, 220, 230, 240, 250 and a plurality of coolers 310, 320, 330, 340, 350.

The multistage compressor 200 compresses BOG to a pressure higher than or equal to a pressure required by a generator, preferably higher than or equal to a critical point so as to improve heat exchange efficiency of the first self-heat exchanger 410 and the second self-heat exchanger 420.

As in the ship including the high-pressure engine shown in FIG. 3, the second self-heat exchanger 420 cools BOG L1 having been compressed by the multistage compressor 200 through heat exchange with a fluid L2 having been expanded by the first decompressor 710 as a refrigerant.

As in the ship including the high-pressure engine shown in FIG. 3, since boil-off gas having been compressed by the multistage compressor 200 is precooled in the second self-heat exchanger 420 before being cooled in the first self-heat exchanger 410, the ship according to this embodiment can exhibit improved properties in terms of overall reliquefaction efficiency and reliquefaction amount.

As in the ship including the high-pressure engine shown in FIG. 3, the first decompressor 710 according to this embodiment expands a fluid L2 branched off of a fluid L1 compressed by the multistage compressor 200 and having passed through the second self-heat exchanger 420 and the first self-heat exchanger 410 to a pressure required by the generator.

The second decompressor 720 expands and reliquefies the rest of the fluid L1 compressed by the multistage compressor 200 and having passed through the second self-heat exchanger 420 and the first self-heat exchanger 410.

Each of the first decompressor 710 and the second decompressor 720 may be an expansion device or an expansion valve.

As in the ship including the high-pressure engine shown in FIG. 3, the ship according to this embodiment may further include a gas/liquid separator 500 that separates gaseous BOG and liquefied natural gas generated by partial reliquefaction of the BOG through compression by the multistage compressor 200, cooling by the second self-heat exchanger 420 and the first self-heat exchanger 410, and expansion by the second decompressor 720. The liquefied natural gas separated by the gas/liquid separator 500 may be sent to the storage tank 100 and the gaseous BOG separated by the gas/liquid separator 500 may be sent to the line along which the BOG is sent from the storage tank 100 to the first self-heat exchanger 410.

As in the ship including the high-pressure engine shown in FIG. 3, the ship according to this embodiment may further include at least one of a first valve 610 blocking the BOG discharged from the storage tank 100 as needed; and a heater 800 heating the BOG sent to the generator through the first decompressor 710 and the second self-heat exchanger 420. The first valve 610 may be usually maintained in an open state and may be closed upon maintenance or overhaul of the storage tank 100.

In the structure wherein the ship includes the gas/liquid separator 500, the ship may further include a second valve 620 that controls the flow amount of the gaseous BOG separated by the gas/liquid separator 500 and sent to the first self-heat exchanger 410, as in the ship including the high-pressure engine shown in FIG. 3.

The flow of fluid according to this embodiment will be described hereinafter. It should be noted that temperature and pressure of BOG described hereinafter are approximately theoretical values and can be changed depending upon the temperature of the BOG, the pressure required for the engine, design of the multistage compressor, the speed of the ship, and the like.

It will be apparent to those skilled in the art that the present invention is not limited to the embodiments described above and various modifications, changes, alterations, and equivalent embodiments can be made art without departing from the spirit and scope of the present invention.

The invention claimed is:

1. A ship including an engine, the ship comprising:

a first self-heat exchanger performing heat exchange with respect to boil-off gas (BOG) discharged from a storage tank;

a multistage compressor performing multistage compression of the BOG discharged from the storage tank and having passed through the first self-heat exchanger;

a second self-heat exchanger precooling the BOG compressed by the multistage compressor;

a first decompressor expanding a first portion of a fluid cooled by the second self-heat exchanger and the first self-heat exchanger; and a second decompressor expanding a second portion of the fluid cooled by the second self-heat exchanger and the first self-heat exchanger:

a line sending the BOG having passed through the first decompressor and the second self-heat exchanger to at least one of a generator and a low-pressure engine: and a heater disposed on the line, wherein the first self-heat exchanger cools the BOG compressed by the multistage compressor and having passed through the second self-heat exchanger using the BOG discharged from the storage tank as a refrigerant, and the second self-heat exchanger cools the BOG compressed by the multistage compressor using the fluid expanded by the first decompressor as a refrigerant.

2. The ship according to claim 1, wherein the second portion of the fluid expanded by the second decompressor is sent to the storage tank.

3. The ship according to claim 1, further comprising:

a gas/liquid separator disposed downstream of the second decompressor and separating liquefied natural gas and gaseous BOG from each other, wherein the liquefied natural gas separated by the gas/liquid separator is sent to the storage tank and the gaseous BOG separated by the gas/liquid separator is sent to the first self-heat exchanger.

4. The ship according to claim 1, wherein some of the BOG compressed by the multistage compressor is sent to a high-pressure engine.

5. A method comprising:

1) performing multistage compression with respect to boil-off gas (BOG) discharged from a storage tank;

2) precooling the BOG after the multistage compression through heat exchange;

3) cooling the fluid precooled in step 2) through heat exchange with the BOG discharged from the storage tank prior to the multistage compression;

4) expanding, by a first decompressor, a first portion of the fluid cooled in step 3);

5) using the fluid expanded in step 4) as a refrigerant for heat exchange in step 2);

6) expanding and reliquefying, by a second decompressor, a second portion of the fluid cooled in step 3);

7) heating, by a heater, the fluid that has expanded by the first decompressor and subsequently has precooled the BOG in step 2); and 8) sending the fluid heated by the heater to at least one of a generator and a low-pressure engine.

6. The method according to claim 5, further comprising:

9) separating gaseous BOG and liquefied natural gas generated through partial reliquefaction of the BOG expanded in step 6) from each other; and 10) sending the liquefied natural gas separated in step 9) to the storage tank and joining the gaseous BOG gas separated in step 8) with the BOG discharged from the storage tank to be used as a refrigerant for heat exchange in step 2).

7. The method according to claim 5, wherein some of the BOG after the multistage compression in step 1) is sent to a high-pressure engine.

* * * * *